US008863709B2

(12) United States Patent
Tada

(10) Patent No.: US 8,863,709 B2
(45) Date of Patent: Oct. 21, 2014

(54) VALVE TIMING ADJUSTER

(75) Inventor: Kenji Tada, Kariya (JP)

(73) Assignee: Denso Corporation, Kariya (JP)

( * ) Notice: Subject to any disclaimer, the term of this patent is extended or adjusted under 35 U.S.C. 154(b) by 270 days.

(21) Appl. No.: 13/010,187

(22) Filed: Jan. 20, 2011

(65) Prior Publication Data

US 2011/0174252 A1 Jul. 21, 2011

(30) Foreign Application Priority Data

Jan. 20, 2010 (JP) ..... 2010-010172
Dec. 2, 2010 (JP) ..... 2010-269193

(51) Int. Cl.

*F01L 1/34* (2006.01)
*F01L 1/02* (2006.01)
*F01L 1/344* (2006.01)
*F01L 1/053* (2006.01)

(52) U.S. Cl.

CPC ..... *F01L 1/3442* (2013.01); *F01L 1/024* (2013.01); *F01L 2001/34469* (2013.01); *F01L 2103/00* (2013.01); *F01L 1/0532* (2013.01); *F01L 2001/0537* (2013.01); *F01L 2001/3443* (2013.01); *F01L 2001/34479* (2013.01); *F01L 2001/34426* (2013.01)

USPC ..... 123/90.17

(58) Field of Classification Search

USPC ..... 123/90.15, 90.17
See application file for complete search history.

(56) References Cited

U.S. PATENT DOCUMENTS 5,107,804 A 4/1992 Becker et al.
5,172,659 A 12/1992 Butterfield et al.
5,361,735 A 11/1994 Butterfield et al.
5,520,145 A 5/1996 Nagai et al.
5,836,276 A 11/1998 Iwasaki et al.
5,875,750 A 3/1999 Iwasaki et al.
6,371,063 B2 * 4/2002 Oyama et al. ..... 123/90.11
6,615,487 B2 9/2003 Iwasaki et al.
7,162,984 B2 1/2007 Sato et al.

(Continued)

FOREIGN PATENT DOCUMENTS

JP H02-50105 4/1990
JP H07-259965 10/1995

(Continued)

OTHER PUBLICATIONS

Great Britain Office Action dated May 17, 2011, issued in corresponding Great Britain Application No. 1100980.0.

(Continued)

*Primary Examiner* — Thomas Denion
*Assistant Examiner* — Daniel Bernstein
(74) *Attorney, Agent, or Firm* — Nixon & Vanderhye PC

(57) ABSTRACT

A valve timing adjuster is mounted to a driving force transmission system, wherein the driving force transmission system transmits a driving force through a timing belt from a drive shaft to a driven shaft. The timing belt is rotatable synchronously with rotation of the drive shaft. The valve timing adjuster includes a pulley part, a housing, and a vane rotor. The pulley part is rotatable synchronously with the drive shaft through engagement with the timing belt. The housing is formed integrally with the pulley part. The vane rotor is received within the housing. The vane rotor is rotatable synchronously with the driven shaft. The vane rotor has a plurality of vane parts that is rotatable relative to the housing within a predetermined angular range.

6 Claims, 12 Drawing Sheets

(56) References Cited

U.S. PATENT DOCUMENTS

| | | | | |
|---|---|---|---|---|
| 7,581,316 | B2 | 9/2009 | Grunow | |
| 7,921,820 | B2 | 4/2011 | Kimura et al. | |
| 2001/0050067 | A1 | 12/2001 | Sato | |
| 2005/0066922 | A1* | 3/2005 | Knecht et al. | 123/90.17 |
| 2006/0042581 | A1 | 3/2006 | Suga et al. | |
| 2008/0022952 | A1 | 1/2008 | Suga et al. | |
| 2009/0071424 | A1 | 3/2009 | Takenaka et al. | |
| 2010/0075765 | A1* | 3/2010 | Isenberg et al. | 464/160 |
| 2010/0218736 | A1* | 9/2010 | Watanabe | 123/90.17 |

FOREIGN PATENT DOCUMENTS

| | | | |
|---|---|---|---|
| JP | 11-218011 | | 8/1999 |
| JP | P2000-282819 | A | 10/2000 |
| JP | P2001-065317 | A | 3/2001 |
| JP | P2002-021513 | A | 1/2002 |
| JP | 2003-254098 | | 9/2003 |
| JP | 2006-125500 | | 5/2006 |
| JP | P2006-183631 | A | 7/2006 |
| JP | P2007-051983 | A | 3/2007 |
| JP | P2007-182826 | A | 7/2007 |
| JP | 2008-204735 | | 9/2008 |
| JP | 2008-240735 | | 10/2008 |
| JP | P2009-138599 | A | 6/2009 |

OTHER PUBLICATIONS

Japanese Office Action dated Dec. 16, 2011, issued in corresponding Japanese Application No. 2010-269193 with English Translation.

Office Action (4 pages) dated Jul. 8, 2014, issued in corresponding Great Britain Application No. 1100980.0.

* cited by examiner

FIRST AND SECOND COMPARISON EXAMPLE

FIRST COMPARISON EXAMPLE

SECOND COMPARISON EXAMPLE

VALVE TIMING ADJUSTER

CROSS REFERENCE TO RELATED APPLICATION

This application is based on and incorporates herein by reference Japanese Patent Application No. 2010-10172 filed on Jan. 20, 2010 and Japanese Patent Application No. 2010-269193 filed on Dec. 2, 2010.

BACKGROUND OF THE INVENTION

1. Field of the Invention

The present invention is related to a valve timing adjuster that changes valve timing of opening and closing at least one of an intake valve and an exhaust valve.

2. Description of Related Art

A conventional vane-type valve timing adjuster opens and closes at least one of an intake valve and an exhaust valve based on a phase difference. The valve timing adjuster generates the phase difference based on a relative rotation between (a) a camshaft and (b) a timing pulley, or a relative rotation between (a) the camshaft and (b) a sprocket, by driving the camshaft through the timing pulley or the sprocket. Typically, the timing pulley and the sprocket rotate synchronously with the crankshaft of an internal combustion engine.

A "pulley-type valve timing adjuster" has a timing belt and a timing pulley. The timing belt serves as a transmission device that transmits a driving force, and the timing pulley serves as a receiving structure that receives the driving force. In contrast, a "sprocket-type valve timing adjuster" has a chain and a sprocket. The chain serves as a transmission device that transmits a driving force, and the sprocket serves a receiving structure that receives the driving force. The timing belt employed in the pulley-type valve timing adjuster is usually made of a rubber, and has projections and recesses at an inner side thereof. Also, the timing pulley has "pulley teeth" at an outer periphery thereof, and the pulley teeth engage with the projections and the recesses of the timing belt. In contrast, the chain employed in the sprocket-type valve timing adjuster is usually made of iron, and the sprocket has gear teeth formed at an outer periphery thereof. The chain engages with the gear teeth of the sprocket.

Because the timing belt is made of the rubber, the timing belt is silently operable and is light weight compared with the iron chain. Also, because the timing belt is light weight, it is possible to further improve the fuel efficiency when mounted on a vehicle.

In general, because the timing belt is wider than the chain, a pulley part, which has a required certain width, is to be provided at an outer peripheral part of the valve timing adjuster. In the above design, the pulley inevitably has a cup shape, and the cup-shaped pulley is provided to cover the outer periphery of the housing of the valve timing adjuster from the rear side of the housing. An example of the above cup shape is described in JP-A-2008-204735.

If the pulley has the cup shape, the timing belt, which engages with the outer periphery of the pulley, radially inwardly applies load to the outer wall of the pulley, resulting in the deformation of the pulley. When the pulley is leaning due to the deformation caused by the above load, the timing belt may be erroneously displaced. Thus, in order to prevent the deformation, it is required to make the outer wall thicker, and thereby the valve timing adjuster becomes greater in weight disadvantageously. Therefore, even when the timing belt is light weight, the total weight of the valve timing adjuster having the timing belt and the pulley becomes greater. As a result, the cup-shaped pulley may degrade the fuel efficiency when mounted on the vehicle.

Furthermore, the timing belt has poor durability although the timing belt has the certain advantages as above. For example, the timing belt is easy to deteriorate when subjected to oil. Thus, it is required to prevent the leakage of a small amount of oil out of the pulley-type valve timing adjuster even though the above amount of oil may be acceptable in the sprocket-type valve timing adjuster.

For example, if a porous metal sintered body is used for the outer casing component of the valve timing adjuster, oil may leak. In order to prevent the leakage, a certain process, such as a sealing process or a resin impregnation process, is required for the sintered body component. As a result, the manufacturing cost increases.

Furthermore, instead of using a porous component for the outer casing component of the valve timing adjuster, a component made by machining a steel product may be alternatively employed for the prevention of the oil leakage. However, in the above alternative case, the product weight may be increased, or the manufacturing cost may increase.

SUMMARY OF THE INVENTION

The present invention is made in view of the above disadvantages. Thus, it is an objective of the present invention to address at least one of the above disadvantages.

To achieve the objective of the present invention, there is provided a valve timing adjuster mounted to a driving force transmission system. The driving force transmission system transmits a driving force through a timing belt from a drive shaft to a driven shaft that opens and closes at least one of an intake valve and an exhaust valve. The timing belt is rotatable synchronously with rotation of the drive shaft. The valve timing adjuster includes a pulley part, a housing, and a vane rotor. The pulley part is rotatable synchronously with the drive shaft through engagement with the timing belt. The housing is formed integrally with the pulley part. The vane rotor is received within the housing. The vane rotor is rotatable synchronously with the driven shaft. The vane rotor has a plurality of vane parts that is rotatable relative to the housing within a predetermined angular range.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

First Embodiment

The first embodiment of the present invention will be described with reference to FIGS. 1 to 7.

Figure 1:
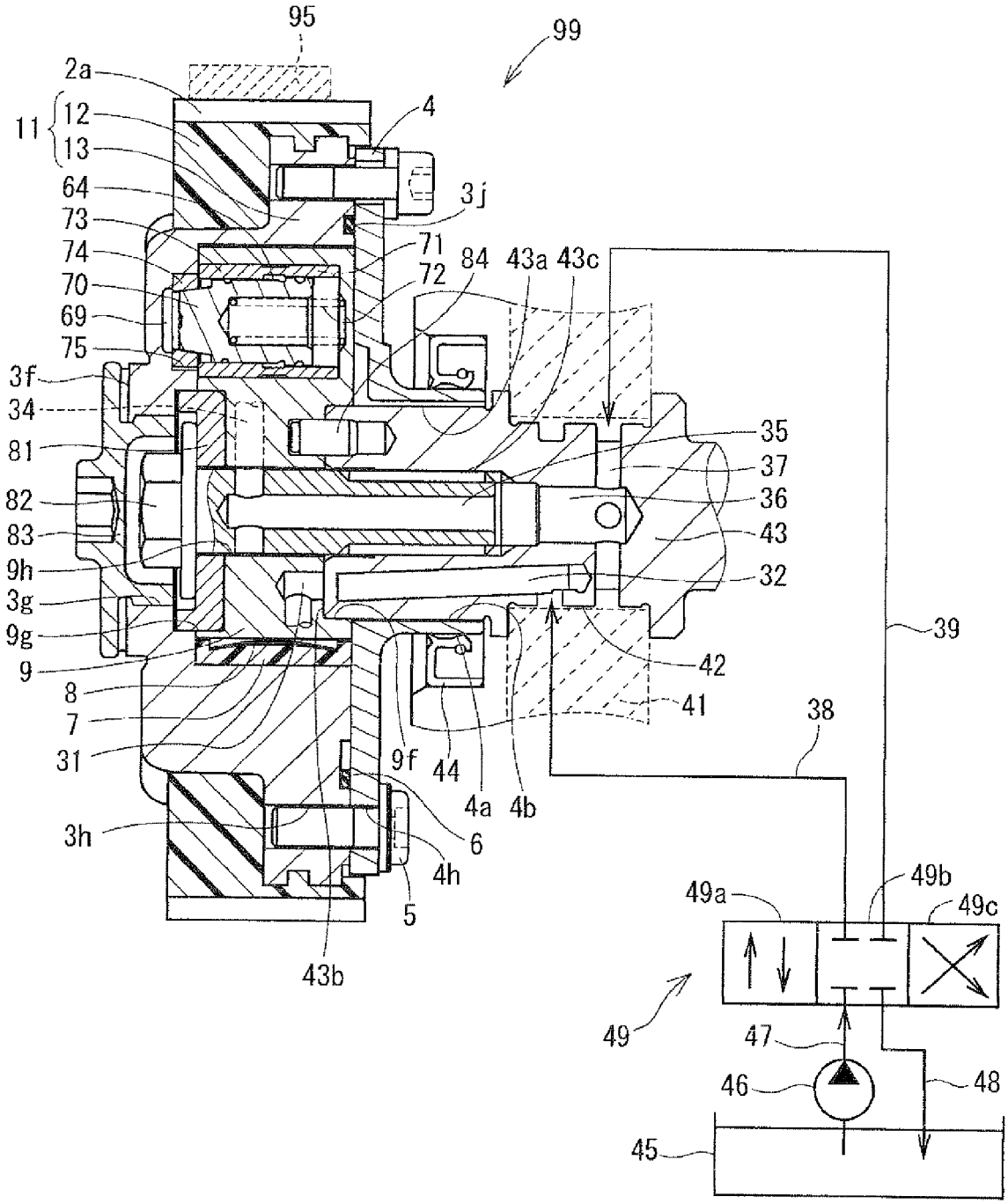
FIG. 1 is a cross-sectional view illustrating a valve timing adjuster according to the first embodiment of the present invention.

FIG. 1 is a cross-sectional view illustrating a valve timing adjuster according to the first embodiment of the present invention, and illustrates a state, where the valve timing adjuster is assembled to a camshaft. FIG. 1 also illustrates an oil pressure supply circuit. FIG. 1 will be detailed later.

Figure 2:
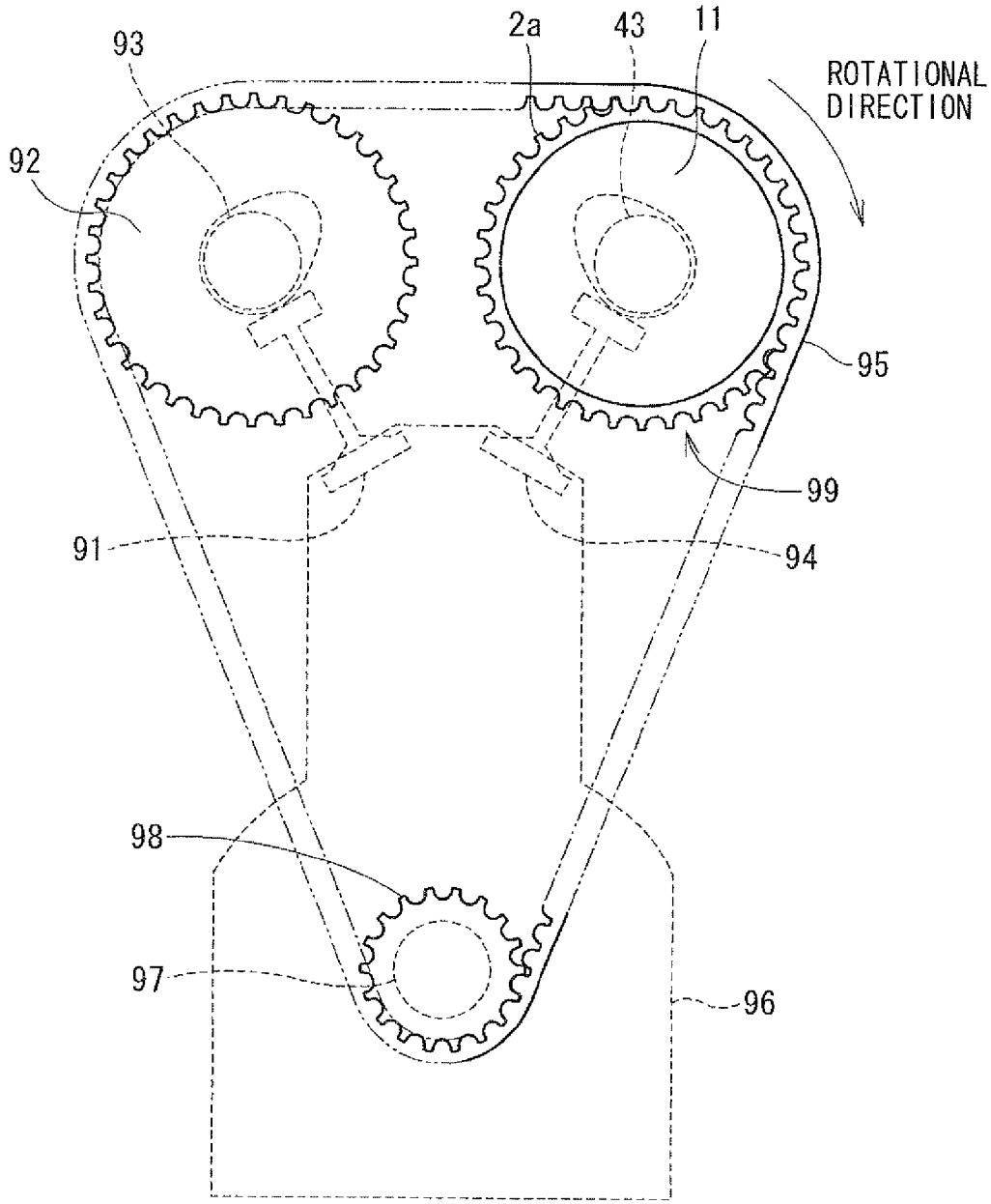
FIG. 2 is a schematic drawing of an internal combustion engine, to which the valve timing adjuster of the first embodiment of the present invention is employed.

In FIG. 2, an internal combustion engine 96 includes a crankshaft 97 and a camshaft 43. The crankshaft 97 corresponds to a "drive shaft", and the camshaft 43 is provided to an intake valve 94 and corresponds to a "driven shaft".

A valve timing adjuster 99 is applied to the intake valve 94 and opens and closes the intake valve 94 by a predetermined phase difference from the crankshaft 97. The valve timing adjuster 99 includes a pulley-integrated housing 11, and the pulley-integrated housing 11 includes a "pulley part" and a "housing formed integrally with the pulley part".

The pulley-integrated housing 11 is provided coaxially to the camshaft 43. Similarly, an exhaust valve pulley 92 is provided coaxially to a camshaft 93, and a drive shaft pulley 98 is provided coaxially to the crankshaft 97. The camshaft 43 opens and closes the intake valve 94, and in contrast, the camshaft 93 opens and closes an exhaust valve 91. Each of the pulley-integrated housing 11, the exhaust valve pulley 92, and the drive shaft pulley 98 has a respective pulley teeth 2*a* formed at outer peripheries thereof.

A timing belt 95 is made of a rubber and is a ring belt. The timing belt 95 has protrusions and recesses formed at an inner side of the ring thereof. The protrusions and recesses are arranged in a direction, in which the timing belt 95 extends, and are engageable with the pulley teeth 2*a*. The toothed timing belt 95 is installed over and rotates around the pulley-integrated housing 11, the exhaust valve pulley 92, and the drive shaft pulley 98. As a result, a driving force of the crankshaft 97 is transmitted to the pulley-integrated housing 11 and the exhaust valve pulley 92, and thereby the pulley-integrated housing 11 and the exhaust valve pulley 92 rotate synchronously with the crankshaft 97.

(Pulley Assembly)

In the description of a pulley-type valve timing adjuster, firstly, a configuration of a "pulley assembly" that has not been assembled to the camshaft will be described.

Figure 3:
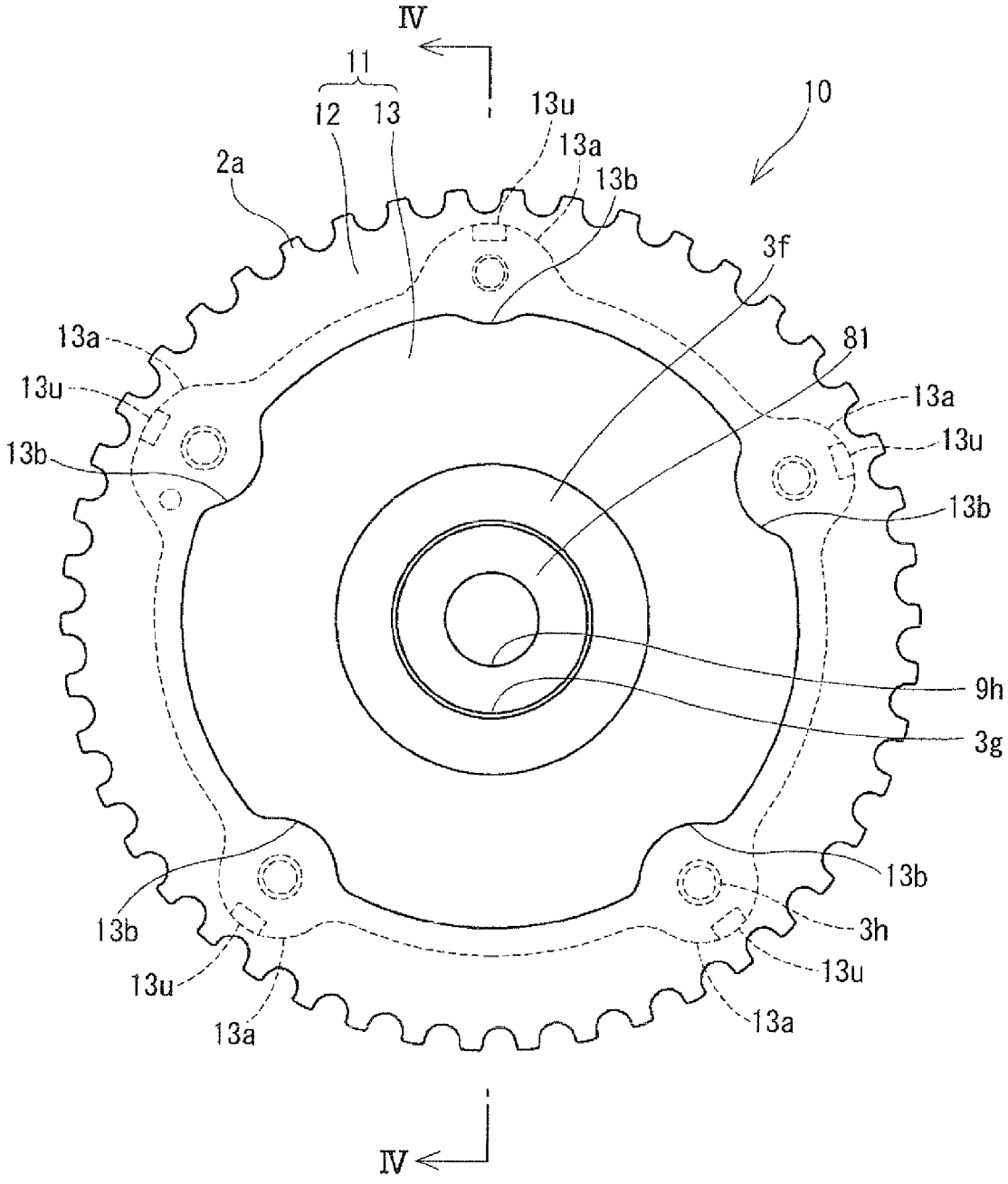
FIG. 3 is a front view of a pulley assembly of the valve timing adjuster according to the first embodiment of the present invention.
Figure 4:
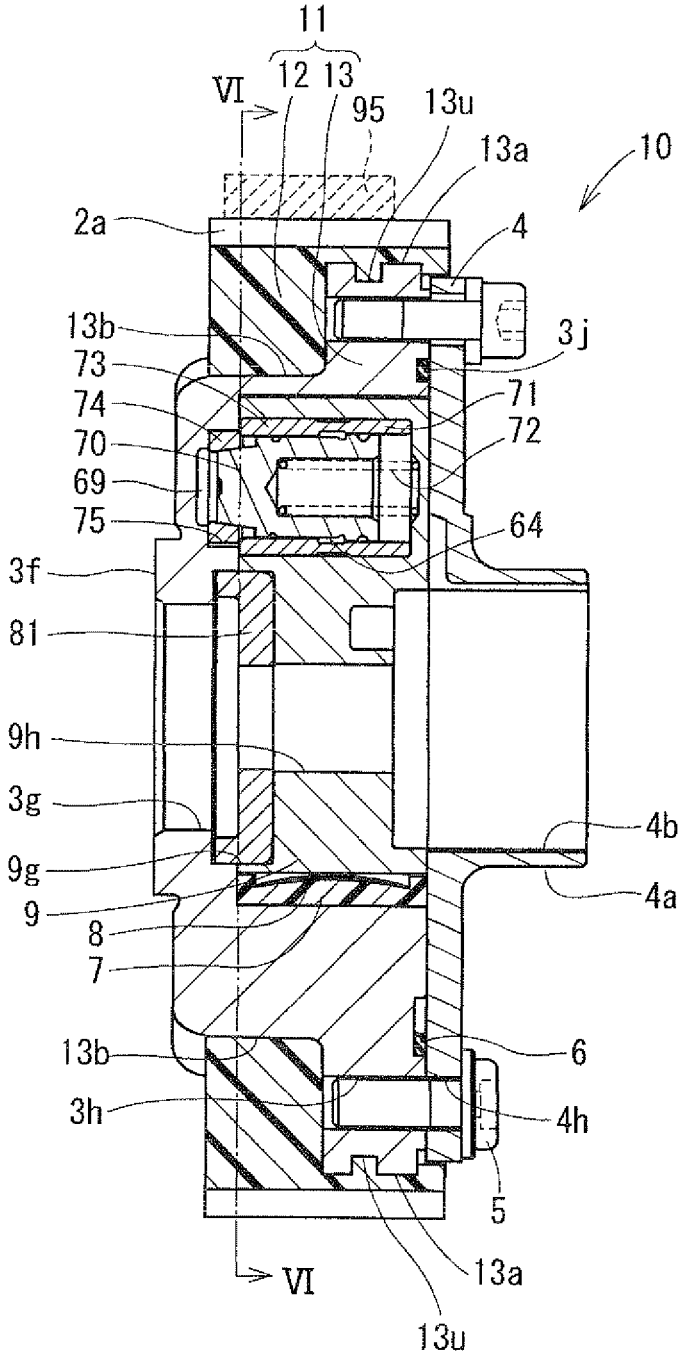
FIG. 4 is a cross-sectional view of the pulley assembly taken along line IV-IV of FIG. 3.
Figure 5:
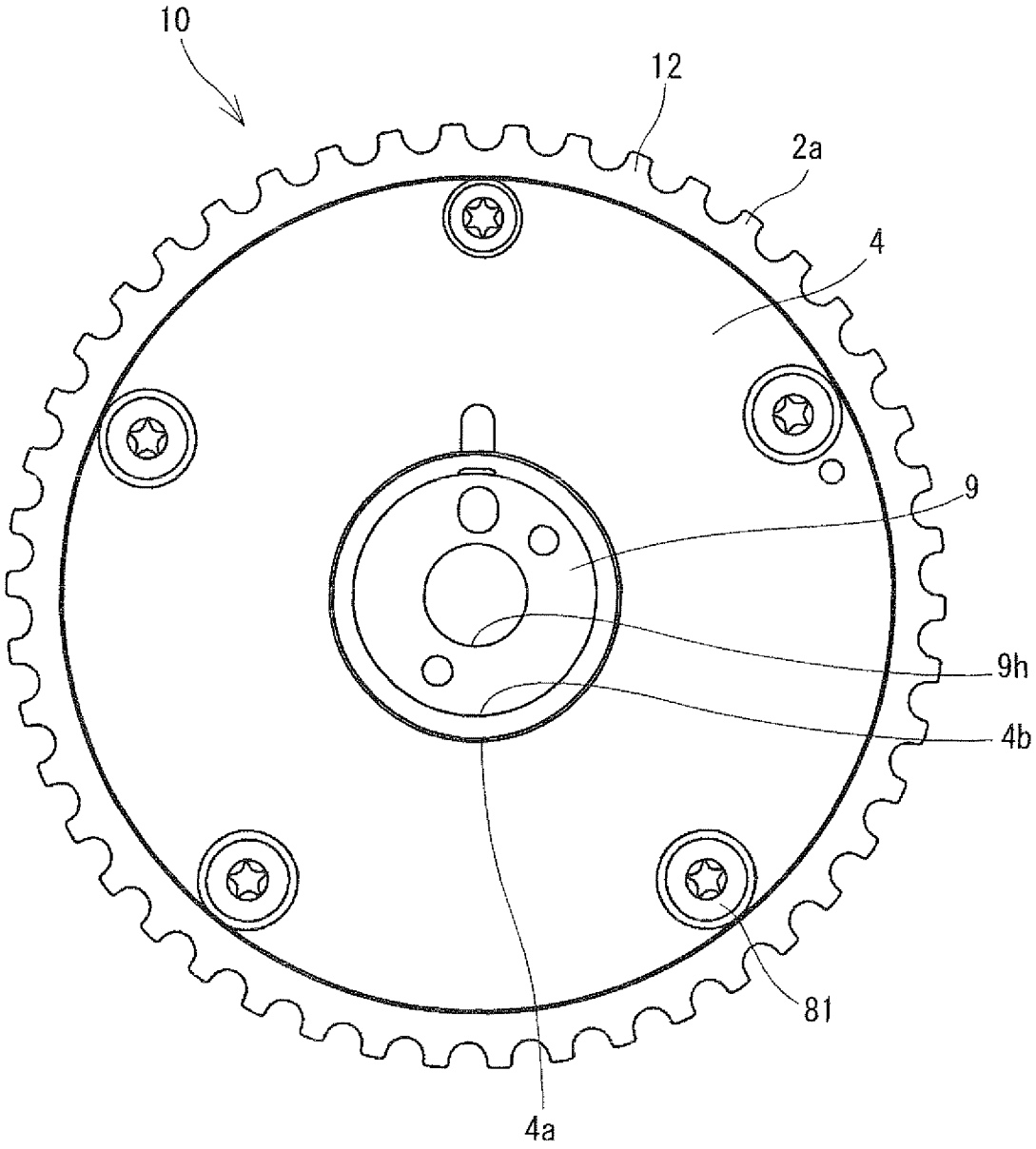
FIG. 5 is a rear view of the pulley assembly of the valve timing adjuster according to the first embodiment of the present invention.
Figure 6:
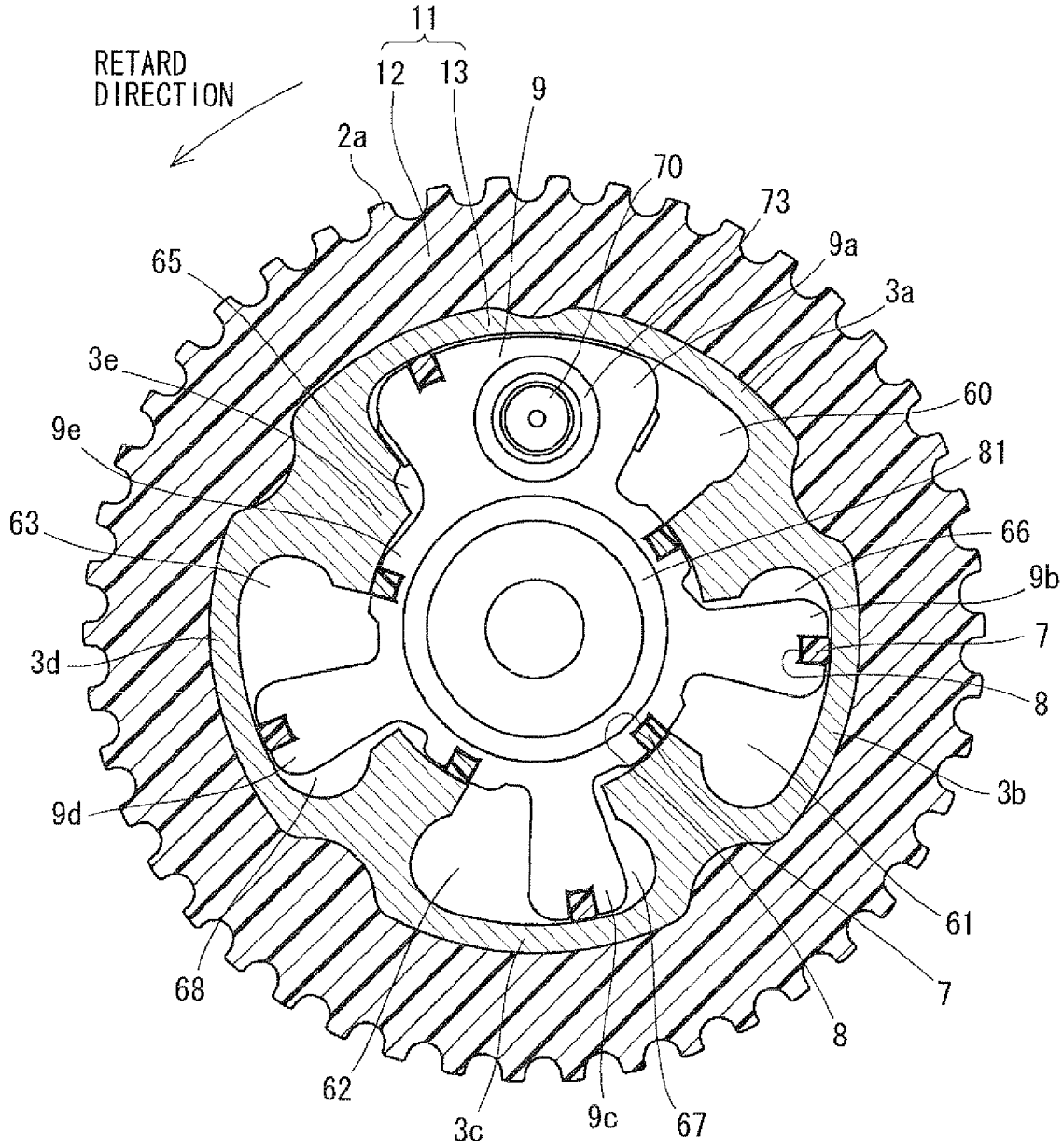
FIG. 6 is a cross-sectional view taken along line VI-VI of FIG. 4 illustrating a full retard position of the valve timing adjuster according to the first embodiment of the present invention.
Figure 7:
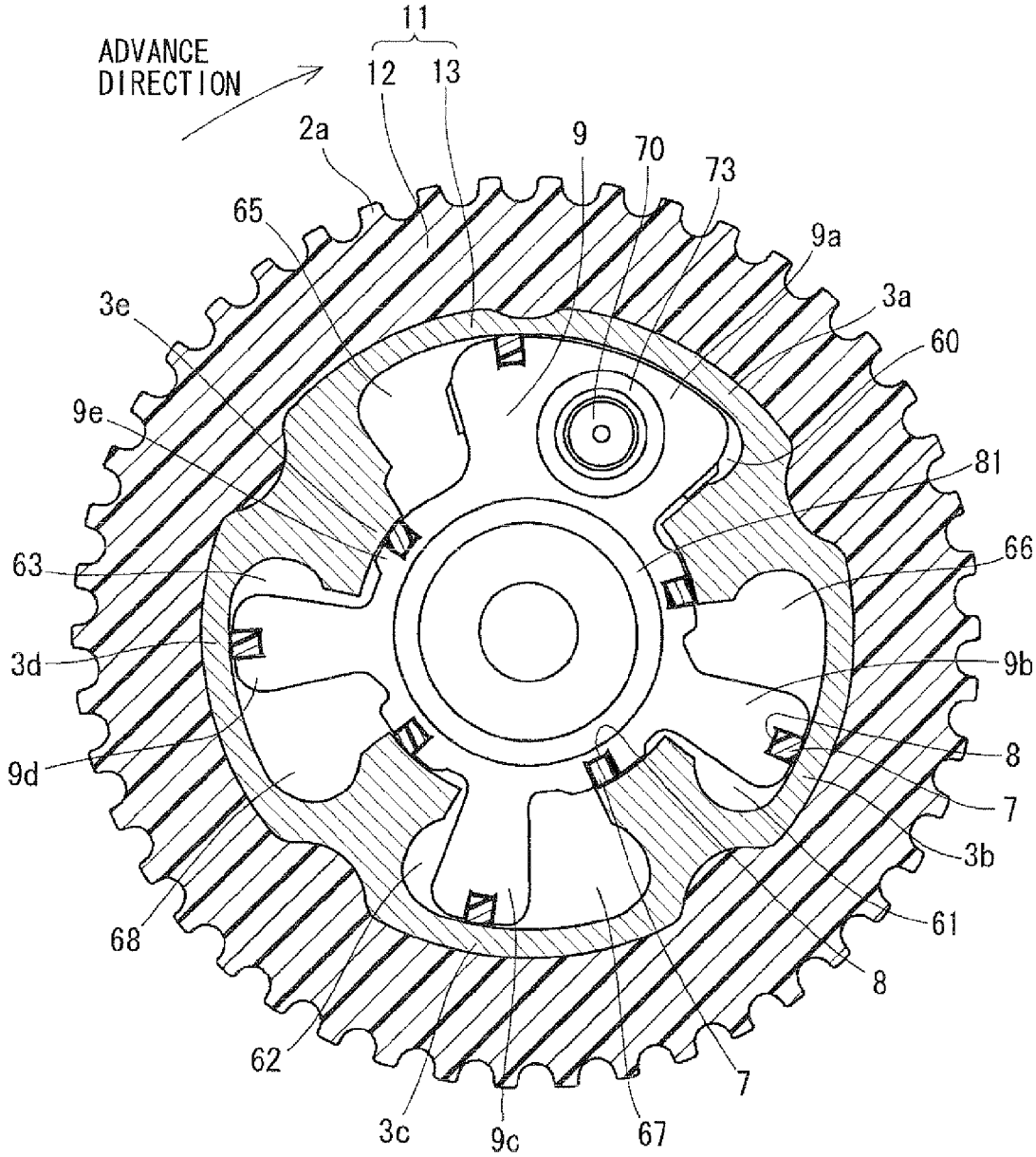
FIG. 7 is a cross-sectional view taken along line VI-VI of FIG. 4 illustrating a full advance position of the valve timing adjuster according to the first embodiment of the present invention.

FIGS. 3 to 7 illustrate the "pulley assembly" of the valve timing adjuster of the first embodiment. FIG. 3 illustrates a front view of a pulley assembly 10, FIG. 5 illustrates a rear view thereof, and FIG. 4 is a cross-sectional view of the pulley assembly 10 taken along line IV-IV of FIG. 3. FIGS. 6 and 7 are cross-sectional views taken along line VI-VI of FIG. 4.

In the present specification, "timing advance" indicates advancing of valve timing, and "timing retard" indicates retarding the valve timing. In FIGS. 6 and 7, a clockwise direction indicates an "advance direction", and a counter-clockwise direction indicates a "retard direction". A side of an object in the advance direction indicates an "advance side", and a side of the object in the retard direction indicates a "retard side". Also, an operation in the advance direction indicates an "advance operation", and an operation in the retard direction indicates a "retard operation".

A vane rotor 9 rotates relative to the pulley-integrated housing 11 within a "predetermined angular range". In the present embodiment, "relative rotation" indicates that the vane rotor 9 rotates coaxially relative to the pulley-integrated housing 11. Also, a "predetermined angular range" has upper and lower limits defined by a "full advance position" and a "full retard position".

FIG. 6 illustrates the "full retard position". When the vane rotor 9 is at the full retard position, a stopper pin 70 is fitted with a stopper ring 74 as shown in FIG. 4. FIG. 7 illustrates a "full advance position". FIG. 7 is a cross-sectional view taken along line VI-VI of FIG. 4 in a state, where the stopper pin 70 is disengaged from the stopper ring 74.

As shown in FIG. 4, a housing 13 is formed integrally with a pulley part 12, and the housing 13 and the pulley part 12 constitute the pulley-integrated housing 11. The housing 13 is made through, for example, an aluminum die-cast process. The pulley part 12 is made of, for example, a resin having substantial heat resistance and abrasion resistance, such as a polyimide resin having glass fiber. During the injection molding process of the resin, the housing 13 is inserted into a molding die, and the injection molding is executed in order to obtain the pulley-integrated housing 11.

The housing 13 has five pairs of a protrusion 13*a* and a recess 13*b* arranged at respective five positions in a circumferential direction as shown in FIG. 3. The housing 13 has a bonding surface that is bonded to the pulley part 12, and the protrusion 13*a* projects radially outwardly from the bonding surface. Also, the protrusion 13*a* is continuously and circumferentially provided at an outer peripheral surface of the housing 13. Also, the recess 13*b* is recessed at the bonding surface of the housing 13, and the recess 13*b* is continuously provided at the outer peripheral surface of the housing 13. Also, a crest part of each protrusion 13*a* is provided with an undercut part 13*u*. In other words, the undercut part 13*u* is recessed at the bonding surface of the housing 13 partially at the crest part of the protrusion 13*a*.

The protrusion 13*a*, the recess 13*b*, the undercut part 13*u* correspond to a "recess/protrusion part". During the molding process of the pulley part 12, a molten resin is provided around the protrusion and enters into the recess, and then shrinks while curing.

A primary work piece of the pulley-integrated housing 11 formed as above is secondary-machined through a machine processing, and a coaxial hole and an end surface of the secondary work are highly precisely finished. As above, the pulley-integrated housing 11 is completed as a component.

The housing 13 receives therein the vane rotor 9. The pulley part 12 has the pulley teeth 2*a* at the outer periphery, and engages with the timing belt 95 through the pulley teeth 2*a* to rotate synchronously with the crankshaft 97. By forming the housing 13 integrally with the pulley part 12, the pulley-integrated housing 11, which is a single component, is capable of functioning as both "receiving therein the vane rotor 9" and "rotating in engagement with the timing belt 95". Thus, it is possible to reduce the number of components, and thereby it is possible to reduce a manufacturing cost, which is computed based on the man-hours of management of the components and the man-hours of assembly.

Each part of the pulley assembly 10 will be described below. A left side of FIG. 4 is indicated by a "front side", and a right side of FIG. 4 is indicated as a "rear side".

The housing 13 opens at the rear side and has a bottom end at the front side to have a cover shape that defines an inner space therein. Four shoe parts 3*a*, 3*b*, 3*c*, 3*d* and central wall parts 3*e* define the inner space as shown in FIGS. 6 and 7. The shoe parts 3*a*, 3*b*, 3*c*, 3*d* radially outwardly project in four directions from the central wall parts 3*e*.

Radially inner wall surfaces of the central wall parts 3*e* are formed between the shoe parts 3*a*, 3*b*, 3*c*, 3*d* in the circumferential direction, and the cross section of each inner wall surface has an arc shape when taken along a plane perpendicular to the rotation axis of the vane rotor 9. Also, an inner wall surface of each of the shoe parts 3*a*, 3*b*, 3*c*, 3*d* has a cross section having an arc shape taken along the above perpendicular plane. In addition to the above, walls of the shoe parts 3*a*, 3*b*, 3*c*, 3*d* on the advance side and on the retard side thereof are connected with the central wall parts 3*e*.

The housing 13 has a front surface 3*f* at a front side center section thereof. The front surface 3*f* has a central hole 3*g* at a center thereof. Also, the shoe part 3*a* has a stopper ring hole 75 at a bottom portion thereof. In contrast, the housing 13 has an O-ring groove 3*j* at a rear end surface thereof, and the O-ring groove 3*j* is provided at a position radially outward of the shoe parts 3*a*, 3*b*, 3*c*, 3*d*. The O-ring groove 3*j* is mounted with an O-ring 6. Also, five tap holes 3*h* are provided at five positions radially outward of the O-ring groove 3*j*. The tap holes 3*h* are provided at the circumferential positions that correspond to the protrusions 13*a* and the recesses 13*b* of the housing 13.

Next, the vane rotor 9 has a rotor body part 9*e* and vane parts 9*a*, 9*b*, 9*c*, 9*d*. The rotor body part 9*e* is received within the central wall parts 3*e* of the housing 13, and the vane parts 9*a*, 9*b*, 9*c*, 9*d* are received within the respective shoe parts 3*a*, 3*b*, 3*c*, 3*d*.

It should be noted that the vane part 9*a* has a circumferential width greater than a circumferential width of each of the other vane parts 9*b*, 9*c*, 9*d*. As a result, when the vane rotor 9 is located at the full retard position, a retard side surface of the vane part 9*a* contacts a retard side inner wall of the shoe part 3*a*. Also, when the vane rotor 9 is located at the full advance position, an advance side surface of the vane part 9*a* contacts an advance side inner wall of the shoe part 3*a*. In contrast, retard side surfaces and advance side surfaces of the vane parts 9*b*, 9*c*, 9*d* do not contact the respective inner walls of the shoe parts 3*b*, 3*c*, 3*d* at the full retard position and the full advance position.

Due to the above configuration, four pairs of a retard hydraulic chamber and an advance hydraulic chamber are formed.

(a) In a space surrounded by the shoe part 3*a*, the vane part 9*a*, and the rotor body part 9*e*, the space on the advance side of the vane part 9*a* defines a retard hydraulic chamber 60, and the space on the retard side of the vane part 9*a* defines an advance hydraulic chamber 65.

(b) In a space surrounded by the shoe part 3*b*, the vane part 9*b*, and the rotor body part 9*e*, the space on the advance side of the vane part 9*b* defines a retard hydraulic chamber 61, and the space on the retard side of the vane part 9*b* defines an advance hydraulic chamber 66.

(c) In a space surrounded by the shoe part 3*c*, the vane part 9*c*, and the rotor body part 9*e*, the space on the advance side of the vane part 9*c* defines a retard hydraulic chamber 62, and the space on the retard side of the vane part 9*c* defines an advance hydraulic chamber 67.

(d) In a space surrounded by the shoe part 3*d*, the vane part 9*d*, and the rotor body part 9*e*, the space on the advance side of the vane part 9*d* defines a retard hydraulic chamber 63, and the space on the retard side of the vane part 9*d* defines an advance hydraulic chamber 68.

Seal members 7 are provided at outer peripheral parts of the rotor body part 9*e* and at outer peripheral parts of the vane parts 9*a*, 9*b*, 9*c*, 9*d*. Each of the seal members 7 faces the corresponding inner wall surface of the housing 13, and is urged toward the inner wall surface by a leaf spring 8 such that oil does not internally leak through a clearance at the slide portion defined between the vane rotor 9 and the housing 13 (see FIGS. 6 and 7).

Also, the vane rotor 9 has a through hole 9*h* at a center thereof. The through hole 9*h* has a rear socket joint 9*f* formed coaxially thereto at the rear side. Also, the through hole 9*h* has a front socket joint 9*g* formed coaxially thereto at the front side. The front socket joint 9*g* is fitted with a center washer 81.

Next, a configuration of a stopper mechanism will be described.

The stopper pin 70 is received within a receiving hole 71 that is provided to the vane part 9*a*. The receiving hole 71 is a blind hole. The stopper ring 74 is fitted into the stopper ring hole 75 of the housing 13. A radially inner part of the stopper ring 74 is tapered such that the front side of the stopper ring 74 adjacent the bottom of the stopper ring hole 75 has an inner diameter smaller than an inner diameter of the rear side of the stopper ring 74 adjacent the opening portion of the stopper ring hole 75. A radially outer part of the front end portion of the stopper pin 70 is tapered by an angle that coincides with the taper angle of the radially inner part of the stopper ring 74, and thereby the stopper pin 70 is fittable into the stopper ring 74.

A spring 72 is inserted into a clearance between a bottom portion of the receiving hole 71 and the stopper pin 70, and the spring 72 urges the stopper pin 70 toward the stopper ring 74. A guide bush 73 is fitted into the receiving hole 71, and a radially outer part of the stopper pin 70 is fitted with a radially inner part of the guide bush 73 at a central longitudinal position such that the displacement of the stopper pin 70 in the longitudinal direction is guided.

A pressure-receiver groove is provided to the stopper pin 70 at a position in the longitudinal direction, and a hydraulic chamber 64 is defined by the pressure-receiver groove and a radially inner part of the guide bush 73. A radial surface of the guide bush 73 is provided with an oil passage (not shown), through which pressurized oil is introduced to the hydraulic chamber 64 during the retard operation.

A hydraulic chamber 69 is defined by the end portion of the stopper pin 70, the stopper ring 74, and the bottom portion of the stopper ring hole 75. Also, an oil passage (not shown) is provided to introduce pressurized oil to the hydraulic chamber 69 during the advance operation.

Due to the above configuration, when pressurized oil is introduced to the hydraulic chamber 64 or to the hydraulic chamber 69, the stopper pin 70 displaces toward the bottom portion of the receiving hole 71 against the biasing force of the spring 72. In other words, the stopper pin 70 displaces in a rightward direction in FIG. 4. As a result, the stopper pin 70 gets out of (, or is disengaged from) the stopper ring 74.

At the full retard position shown in FIG. 6, because the stopper pin 70 is fitted into the stopper ring 74, the vane rotor 9 is connected with the pulley-integrated housing 11, and thereby rotating synchronously with the pulley-integrated housing 11. In other words, the vane rotor 9 does not rotate relative to the pulley-integrated housing 11.

When the stopper pin 70 has moved out of the stopper ring 74, the vane rotor 9 is disconnected from or disengaged from the pulley-integrated housing 11, and thereby the vane rotor 9 becomes movable within an angular range defined between the full retard position and the full advance position.

Next, a front end surface of a rear plate 4 contacts a rear end surface of the housing 13. Five threaded members 5 extend through threaded holes 4*h* of the rear plate 4, and are fitted into the tap holes 3*h* of the housing 13. As a result, the rear plate 4 is fastened to the pulley-integrated housing 11. In the above situation, the O-ring 6 prevents the leakage of oil to the exterior through a boundary between the housing 13 and the rear plate 4. Also, the threaded members 5 are fastened to the housing 13 but not to the pulley part 12, which is made of resin. As a result, the rear plate 4 and the housing 13, which are both made of a metal, are rigidly fixed to each other.

The rear plate 4 is made through the machining of a steel product that serves as a "solid material". In other words, the rear plate 4 is not made of a porous material, such as a sintered body. As a result, it is possible to prevent oil from permeating through the rear plate 4. Therefore, it is possible to reliably prevent the disadvantage, such as deterioration of the timing belt 95 by the oil leakage.

Also, the rear plate 4 has a tubular portion 4*a* at a rear side center portion thereof. Furthermore, the tubular portion 4*a* has a bearing hole 4*b* at a radially inner side thereof, and the bearing hole 4*b* extends through the rear plate 4.

(Configuration of Valve Timing Adjuster)

Next, a configuration of the valve timing adjuster 99 that has the pulley assembly 10 installed to the camshaft 43 will be described with reference to FIG. 1.

The camshaft 43 has a journal part 42 that is rotatably supported by a bearing part 41 mounted on the cylinder head (not shown), and the journal part 42 is limited from displacing in the rotation axis direction.

The tubular portion 4*a* of the rear plate 4 is received by an oil seal 44.

An end portion 43*a* of the camshaft 43 is rotatably fitted into the bearing hole 4*b* of the rear plate 4, and also is fitted into the rear socket joint 9*f* of the vane rotor 9. An end surface 43*b* of the camshaft 43 contacts a bottom surface of the rear socket joint 9*f*. In the above, a knock pin 84 positions the camshaft 43 relative to the vane rotor 9 in the rotational direction.

A tap hole 43*c* is formed along a center axis of the camshaft 43, and a center oil passage 36 is formed at a back of the tap hole 43*c*. The center oil passage 36 is communicated at a radial surface of the passage 36 with an introduction oil passage 37. Also, an introduction oil passage 32 is formed at an outer peripheral part the camshaft 43 from the end surface 43*b*.

A central bolt 82 extends through a through hole formed at a center of the center washer 81 and through the through hole 9*h* of the vane rotor 9. Then, the central bolt 82 is fastened to the tap hole 43*c* of the camshaft 43 by a predetermined fastening torque. In the above, a seating surface of the head of the central bolt 82 contacts a bottom surface of a countersunk hole of the center washer 81, and thereby the friction between the surfaces prevents the loosening of the bolt. As a result, the vane rotor 9 is coaxially fastened to the camshaft 43. Also, a bolt oil passage 35 is provided along an axis of the central bolt 82, and is communicated with the center oil passage 36.

A central cap 83 is fitted into the central hole 3*g* of the housing 13 such that the central cap 83 covers the head of the central bolt 82 and the front surface 3*f* of the housing 13.

When the vane rotor 9 becomes fastened to the camshaft 43, a retard oil passage 31 of the vane rotor 9 is brought into communication with a main retard oil passage 38 via the introduction oil passage 32. The retard oil passage 31 is communicated with the retard hydraulic chambers 60, 61, 62, 63, and the hydraulic chamber 64 within the vane rotor 9.

Also, an advance oil passage 34 of the vane rotor 9 is communicated with the bolt oil passage 35 via a communication bore formed at a radial surface of the central bolt 82, and the bolt oil passage 35 is communicated with a main advance oil passage 39 via the center oil passage 36 and the introduction oil passage 37. The advance oil passage 34 is communicated with the advance hydraulic chambers 65, 66, 67, 68 and the hydraulic chamber 69 within the vane rotor 9.

A switching valve 49 has two ports adjacent an oil pan 45, and the two ports are connected with a supply oil passage 47 and a drained oil passage 48. More specifically, the supply oil passage 47 allows pressurized oil from an oil pump 46 to be pumped therethrough, and the drained oil passage 48 allows oil to be drained therethrough to the oil pan 45. Also, the switching valve 49 has the other two ports adjacent the valve timing adjuster 99. The other two ports are connected with the main retard oil passage 38 and the main advance oil passage 39.

The switching valve 49 switches the operation between the following three operational modes (a) to (c).

(a) a retard operation mode 49*a*, where the supply oil passage 47 is communicated with the main retard oil passage 38, and the drained oil passage 48 is communicated with the main advance oil passage 39

(b) a stop mode 49*b*, where any of the above communication is disabled (c) an advance operation mode 49*c*, where the supply oil passage 47 is communicated with the main advance oil passage 39, and the drained oil passage 48 is communicated with the main retard oil passage 38

(Operation of Valve Timing Adjuster)

Next, the operation of the valve timing adjuster 99 will be described.

(1) The vane rotor 9 is located at the full retard position as shown in FIG. 6 in an initial state, where pressurized oil from the oil pump 46 has not been introduced to any of the retard hydraulic chambers 60, 61, 62, 63 and the advance hydraulic chambers 65, 66, 67, 68.

The stopper pin 70 is fitted into the stopper ring 74 by the biasing force of the spring 72, and thereby the vane rotor 9 is connected with the pulley-integrated housing 11.

(2) When the switching valve 49 is selectively operated under the advance operation mode 49*c*, pressurized oil from the oil pump 46 is supplied to the advance hydraulic chambers 65, 66, 67, 68 and the hydraulic chamber 69 via the supply oil passage 47, the main advance oil passage 39, the introduction oil passage 37, the center oil passage 36, the bolt oil passage 35, and the advance oil passage 34.

Because oil pressure of the hydraulic chamber 69 is firstly applied to the end portion of the stopper pin 70, the stopper pin 70 is pushed into the bottom portion of the receiving hole 71 against the biasing force of the spring 72, and thereby the vane rotor 9 is disengaged from the pulley-integrated housing 11.

Because oil pressure of the advance hydraulic chambers 65, 66, 67, 68 is applied to the retard side surface of the respective vane part 9*a*. 9*b*, 9*c*, 9*d*, the vane rotor 9 is relatively rotated in the advance direction. Then, the vane rotor 9 is relatively movable up to the full advance position as shown in FIG. 7 at maximum.

Due to the above, valve timing of the camshaft 43 is advanced. Also, pressurized oil of the retard hydraulic chambers 60, 61, 62, 63 is drained to the oil pan 45 through the retard oil passage 31, the introduction oil passage 32, the main retard oil passage 38, and the drained oil passage 48.

(3) Next, when the switching valve 49 is selectively operated under the retard operation mode 49*a*, pressurized oil from the oil pump 46 is supplied to the retard hydraulic chambers 60, 61, 62, 63 and the hydraulic chamber 64 via the supply oil passage 47, the main retard oil passage 38, the introduction oil passage 32, and the retard oil passage 31.

Because oil pressure of the hydraulic chamber 64 is applied to a front side surface of the pressure-receiver groove, the stopper pin 70 is pushed into the bottom portion of the receiving hole 71 against the biasing force of the spring 72. As a result, the stopper pin 70 is maintained completely out of the stopper ring 74. In other words, the vane rotor 9 is maintained disconnected from the pulley-integrated housing 11.

Because oil pressure of the retard hydraulic chambers 60, 61, 62, 63 is applied to the advance side surface of the respective vane part 9*a*, 9*b*, 9*c*, 9*d*, the vane rotor 9 relatively rotates in the retard direction. The vane rotor 9 is relatively movable up to the full retard position as shown in FIG. 6 at maximum.

Due to the above, the valve timing of the camshaft 43 is retarded. Also, pressurized oil of the advance hydraulic chambers 65, 66, 67, 68 is drained to the oil pan 45 through the advance oil passage 34, the bolt oil passage 35, the center oil passage 36, the introduction oil passage 37, the main advance oil passage 39, and the drained oil passage 48.

(4) When the switching valve 49 is selectively operated under the stop mode 49*b* while the vane rotor 9 relatively rotates in the advance direction or in the retard direction, the circulation (inflow and outflow) of pressurized oil in the retard hydraulic chambers 60. 61, 62, 63 and the advance hydraulic chambers 65, 66, 67, 68 is disabled, and thereby the vane rotor 9 is held at an intermediate position. As a result, it is possible to obtain desired valve timing.

Comparison Example

Figure 10:
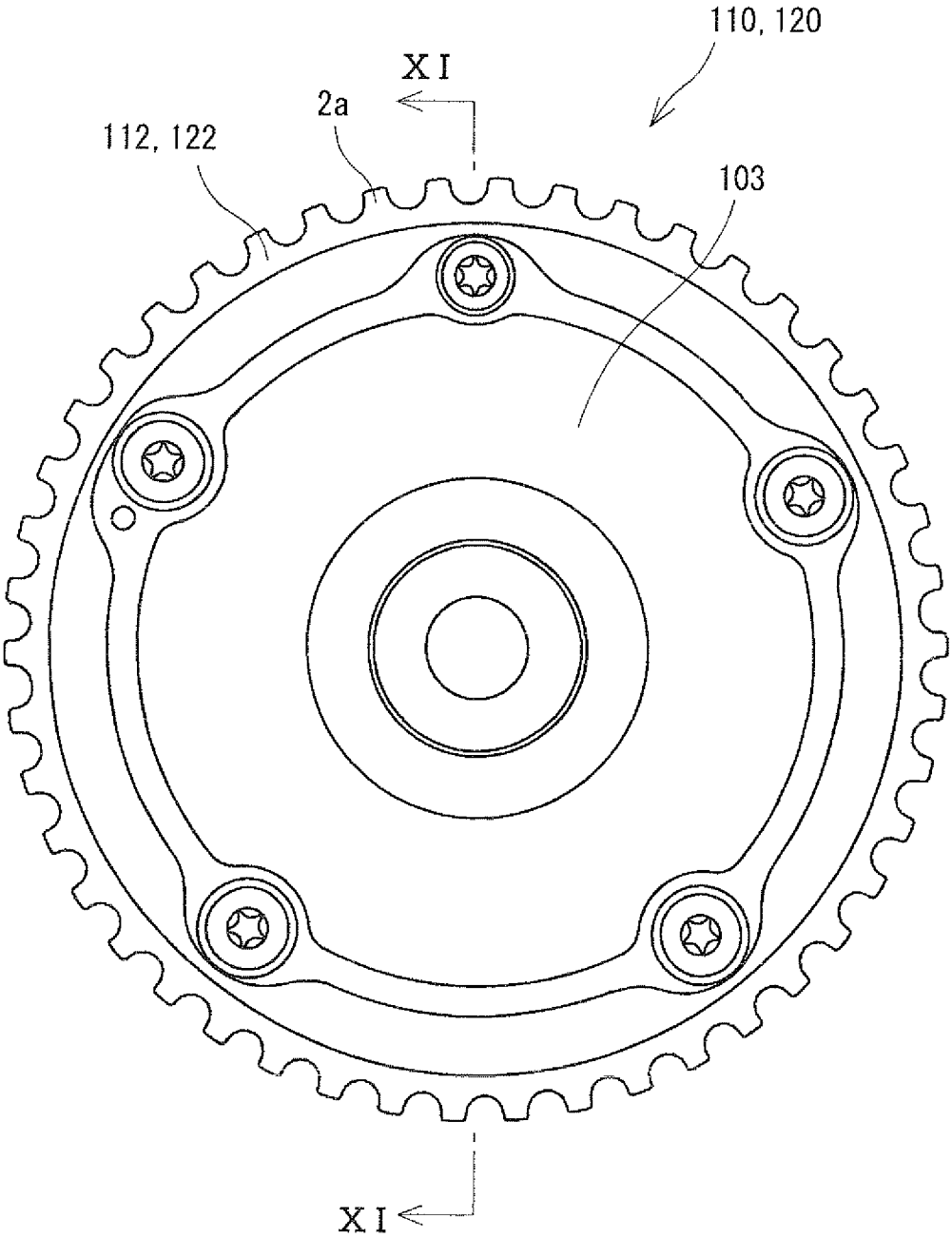
FIG. 10 is a front view of a pulley assembly according to first and second comparison examples.
Figure 11:
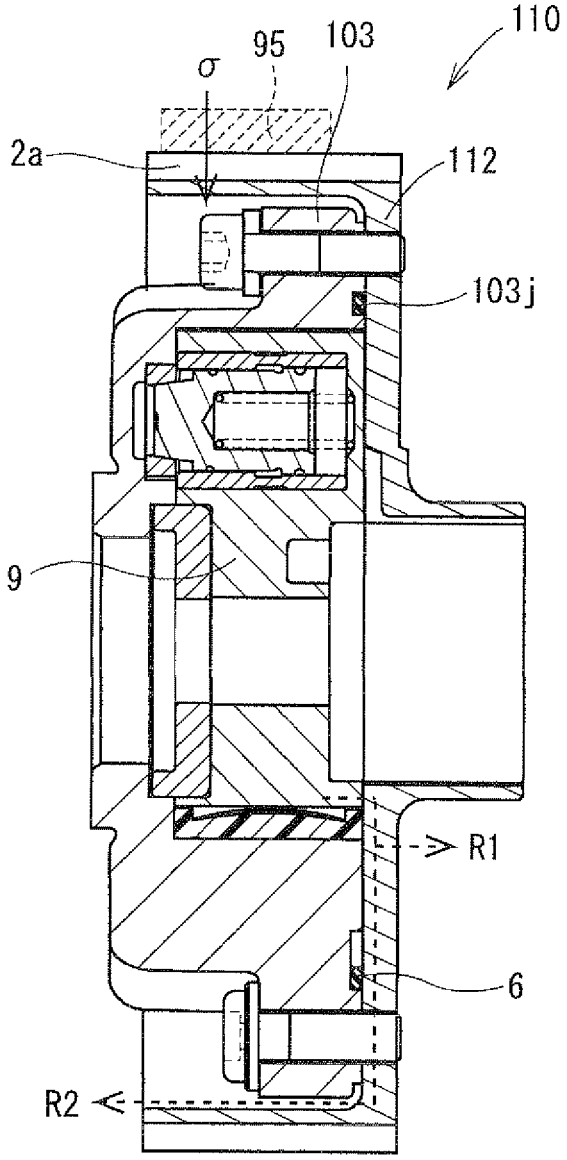
FIG. 11 is a cross-sectional view taken along line XI-XI of FIG. 10 for illustrating the pulley assembly according to the first comparison example.
Figure 12:
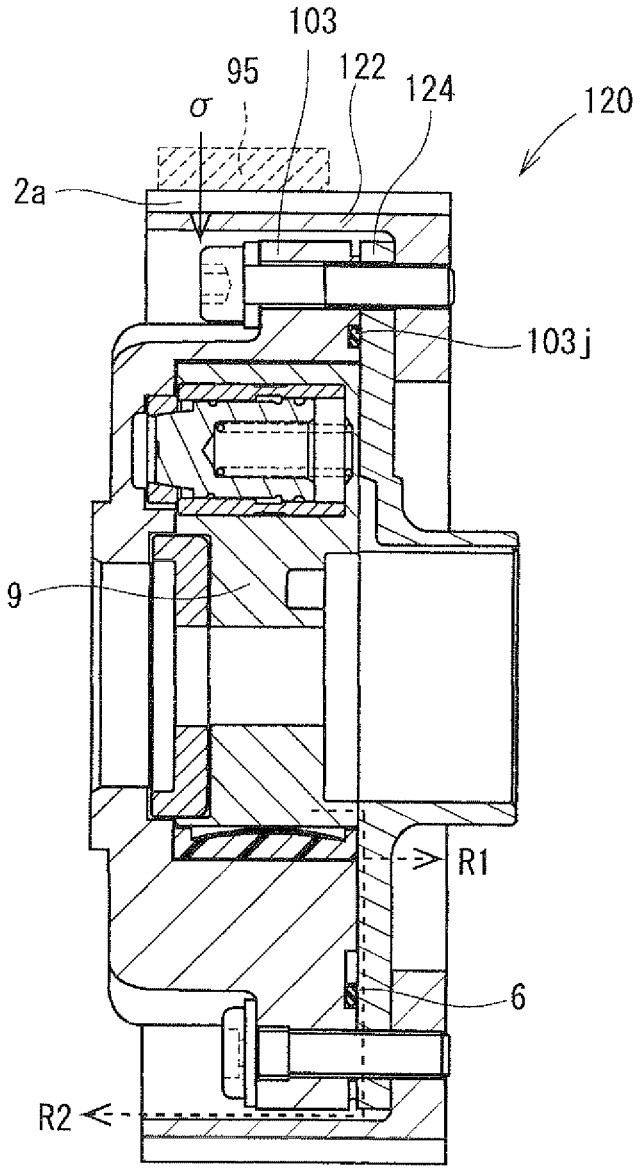
FIG. 12 is another cross-sectional view taken along line XI-XI of FIG. 10 for illustrating the pulley assembly according to the second comparison example.

Next, a pulley assembly of two comparison examples will be described with reference to FIGS. 10 to 12. FIG. 10 is a front view applicable to both of the two comparison examples. Each of FIG. 11 and FIG. 12 is a cross-sectional view taken along line XI-XI of FIG. 10. FIG. 11 illustrates a pulley assembly 110 according to the first comparison example, and FIG. 12 illustrates a pulley assembly 120 according to the second comparison example.

A pulley 112 is manufactured separately from a housing 103 in the first comparison example, and a pulley 122 is also manufactured separately from the housing 103 in the second comparison example. Either of the pulley 112 or the pulley 122 is manufactured to have a cup shape by, for example, a sintering process using a metal that includes an iron as a main component.

The pulley 112 and the pulley 122 are formed into the cup-like shape as shown in FIGS. 11 and 12. If the pulley teeth 2*a* of the pulley 112 (or the pulley 122), which is made separately from the housing 103, is designed to have a width wider than a width of the timing belt 95, the pulley 112 (the pulley 122) has to have the cup-like shape such that the pulley 112 (the pulley 122) is provided from the rear side of the housing 103 to cover the outer periphery.

In a case, where the pulley 112 has the cup shape, the timing belt 95 that engages with the outer periphery of the pulley 112 (the pulley 122) radially inwardly applies load δ to the outer wall of the pulley 112 (the pulley 122), resulting in the radially inward deformation. When the above deformation causes to the pulley 112 (the pulley 122) to lean such that the front side of the outer wall is radially inwardly displaced, the engagement of the timing belt 95 may be erroneously displaced, accordingly. Thus, in order to prevent the above deformation, the thickness of the outer wall is required to be made greater, and as a result, the product weight is increased in the first comparison example.

Also, the problem of the oil leakage will be described below.

In the first comparison example, because the pulley 112 is made of the porous sintered body, oil may permeate to the exterior across the bottom portion of the pulley 112 in a thickness direction thereof as illustrated by a dashed line R1. In order to prevent the leakage, a sealing process or a resin impregnation process of the pulley 112 of the sintered body is required. As a result, the above process results in higher production costs.

It should be noted that because oil may leak to the exterior, as shown by a dashed line R2, through the boundary, at which the bottom portion of the pulley 112 contacts the housing 103, the O-ring 6 is provided to an O-ring groove 103*j* of the housing 103. The above point is similar to the first embodiment of the present invention.

In the second comparison example, the pulley 122 is separate from a rear plate 124. The rear plate 124 is made by machining a steel product without using the porous material. As a result, it is possible to prevent the oil leakage. However, because the number of components is increased, the man power for the component management and for assembly of the components requires higher product cost in the second comparison example.

Compared with the first and second comparison examples, the present embodiment is advantageously light in weight, and has a lower product cost because of the reduction of the number of components. Also, in the present embodiment, because the steel rear plate 4 and the O-ring 6 are employed, the structure is designed to prevent the oil leakage, and thereby it is possible to effectively limit the deterioration of the timing belt 95 through the contact with oil.

Also, in the molding of the pulley part 12, the molten resin is provided around the protrusion and enters into the recess (the protrusion 13*a*, the recess 13*b*, the undercut part 13*u*) formed at the radially outer part of the housing 13, and then the molten resin, which catches therein the part of the housing 13, shrinks while curing. As a result, the pulley part 12 is substantially rigidly bonded to the housing 13 ready for the tensile force of the timing belt 95.

Furthermore, because the threaded members 5 are fastened to the housing 13 but not to the resin pulley part 12, the rear plate 4 and the housing 13, which are both made of a metal, are fixed to each other. As a result, it is possible to effectively limit the deformation and stress concentration in the resin pulley part 12.

Second Embodiment

Figure 8:
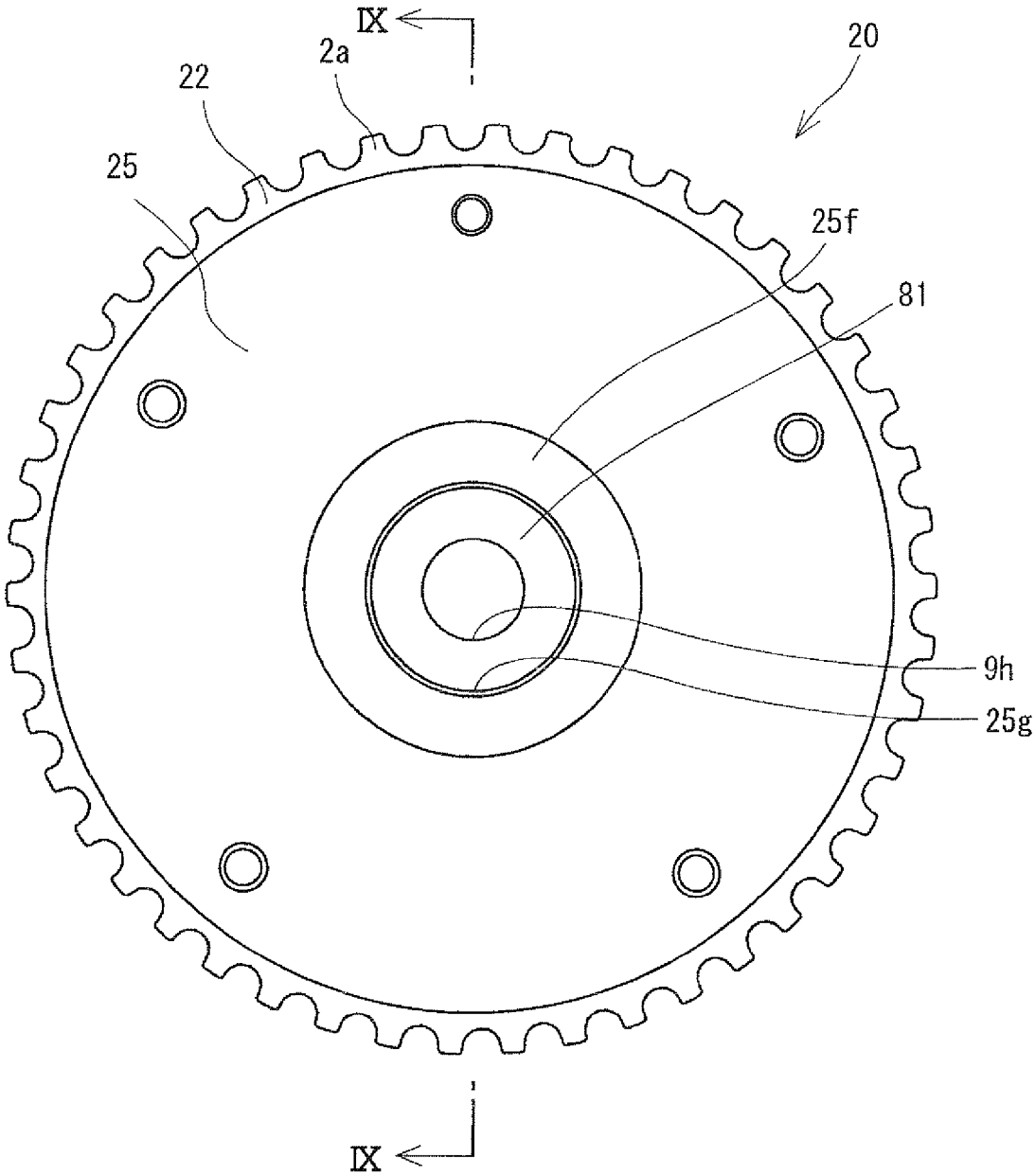
FIG. 8 is a front view of a pulley assembly of a valve timing adjuster according to the second embodiment of the present invention.
Figure 9:
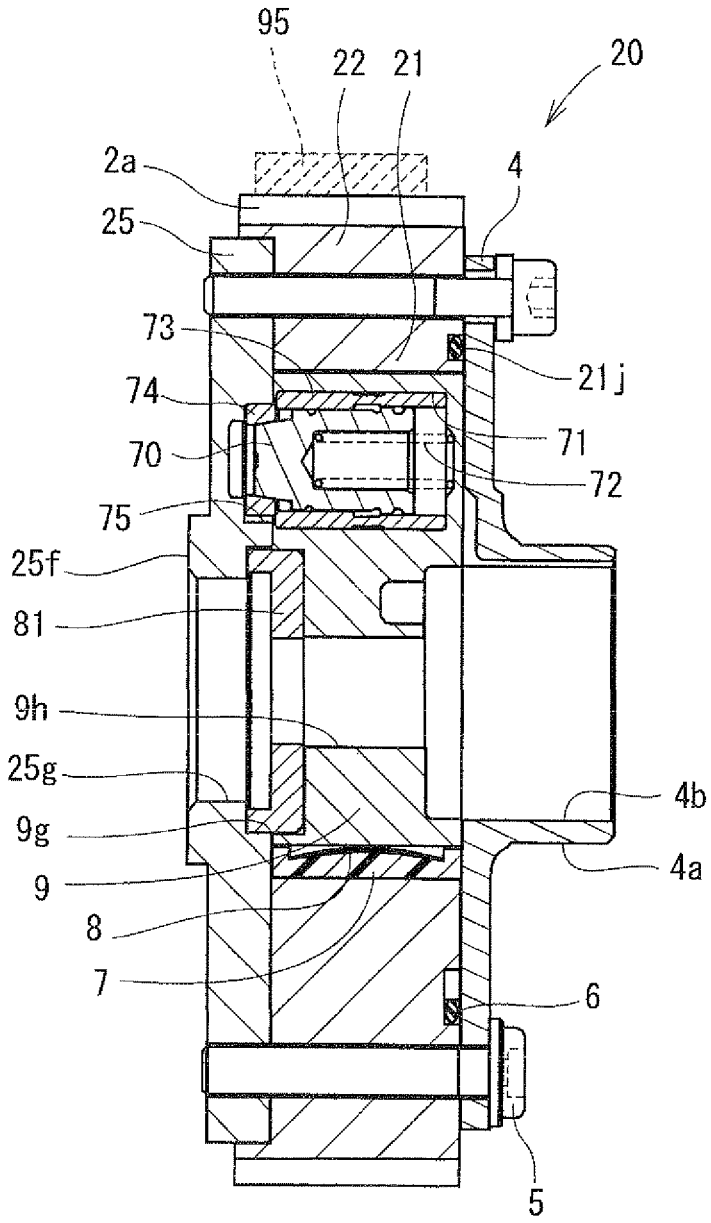
FIG. 9 is a cross-sectional view taken along line IX-IX of FIG. 8.

A pulley assembly of a valve timing adjuster according to the second embodiment of the present invention will be described with reference to FIGS. 8 and 9. FIG. 8 is a front view of a pulley assembly 20, and FIG. 9 is a cross-sectional view taken along line IX-IX of FIG. 8. It should be the configuration and operation of the present embodiment are similar to those in the first embodiment otherwise noted.

A pulley-integrated housing 21 is made through an aluminum sintering process or an aluminum extrusion process. The aluminum sintering process is a method for forming the pulley-integrated housing 21 by sintering aluminum powder in the molding die. The extrusion process is a method for forming the pulley-integrated housing 21 by continuously forming an elongated product having a uniform cross section in the longitudinal direction thereof, and then cutting the elongated product by a predetermined length. In the either method, a primary work piece of the pulley-integrated housing 21 having a pulley part 22 is made of the aluminum. Thus formed primary work piece is machine-processed into a secondary work piece, and then, the secondary work piece is highly precisely finished at the coaxial hole and the end surface. Thus, the work piece is finished as the component.

The pulley-integrated housing 21 is interposed between a front plate 25 and the rear plate 4 and the above components 21, 25, and 4 are fastened to each other through the threaded members 5. The pulley-integrated housing 21 receives therein the vane rotor 9.

The front plate 25 has a front surface 25*f* and a central hole 25*g*, which respectively correspond to the front surface 3*f* and the central hole 3*g* of the housing 13 of the first embodiment. Also, the pulley-integrated housing 21 has an O-ring groove 21*j* that corresponds to the O-ring groove 3*j* of the housing 13 of the first embodiment. The O-ring 6 is inserted into the O-ring groove 21*j*, and as a result, oil leakage through the boundary between the pulley-integrated housing 21 and the rear plate 4 is prevented.

Also, the rear plate 4 is made through machining a steel product that serves as a "solid material". In other words, because the rear plate 4 is made of a material that is different from a porous material, such as sintered body, oil is limited from permeating (or leaking through the rear plate 4. As a result, it is possible to prevent the degradation of the timing belt 95 caused by the oil leakage.

It should be noted that in the present embodiment, the front plate 25 is also made by machining the steel product similarly. As a result, oil is prevented from permeating (or leaking) through the front plate 25.

The pulley part 22 is integrally provided to an outer periphery of the pulley-integrated housing 21, and the pulley part 22 has the pulley teeth 2*a*. The timing belt 95 is installed over the pulley part 22 such that the pulley-integrated housing 21 is rotatable synchronously with the crankshaft 97.

Because the pulley-integrated housing 21, which integrally includes the pulley part 22, serves as a single component, it is possible to reduce the number of components, and thereby reducing the manufacturing cost of the component managing man power or the assembly man power. Also, the aluminum is a light metal having a density of 2.7, and thereby it is possible to reduce the weight of the product.

Other Embodiment

The present invention is not limited to the above embodiment, but is applicable to various embodiments provided that the various embodiments do not deviate from the gist of the invention.

For example, the method for manufacturing the pulley-integrated housing using the aluminum may be a die casting instead of the sintering or the extruding method.

Alternatively, a magnesium may be employed instead of the aluminum. Because the magnesium is a light metal having a density of about 1.8, it is possible to further enhance the weight reduction of the product.

Also, the valve timing adjuster 99 is not limited to be provided to the intake valve 94, but may be provided to the exhaust valve 91. Alternatively, the valve timing adjusters 99 may be provided to both of the intake valve 94 and the exhaust valve 91.

In the first embodiment, where the pulley part is made of the resin, the protrusion 13*a*, the recess 13*b*, and the undercut part 13*u* serve as the "recess/protrusion part". The protrusion 13*a* projects radially outwardly from the bonding surface of the housing 13, which is bonded to the pulley part 12. The recess 13*b* and the undercut part 13*u* are recessed at the bonding surface of the housing 13.

However, the recess/protrusion part may be alternatively provided to a bonding surface of the pulley part, which is bonded to the housing. For example, the recess/protrusion part may radially inwardly projects from the bonding surface of the pulley part, and may be radially outwardly recessed at the bonding surface. Alternatively, the recess/protrusion part may be provided to the bonding surface between the housing and the pulley part to extend in the longitudinal direction instead of the circumferential direction. Also, the recess/protrusion part may be formed to have a continuous groove, for example, and may alternatively have multiple protrusions and recesses, which are separated from each other.

In the above alternative case of the recess/protrusion part, which may extend in various directions, or may have various shapes, in the molding process, the molten resin catches therein the protrusions and enters into the recesses, and then shrinks while curing. As a result, the pulley part is reliably rigidly bonded to the housing ready for the tensile force applied by the timing belt.

Additional advantages and modifications will readily occur to those skilled in the art. The invention in its broader terms is therefore not limited to the specific details, representative apparatus, and illustrative examples shown and described.

What is claimed is:

1. A valve timing adjuster mounted to a driving force transmission system, wherein the driving force transmission system transmits a driving force through a timing belt from a drive shaft to a driven shaft that opens and closes at least one of an intake valve and an exhaust valve, the timing belt being rotatable synchronously with rotation of the drive shaft, the valve timing adjuster comprising:

a pulley part that is rotatable synchronously with the drive shaft through engagement with the timing belt;

a housing formed integrally with the pulley part;

a vane rotor that is received within the housing;

a rear plate facing an opening of the housing and contacting an end surface of the housing, wherein:

the vane rotor is rotatable synchronously with the driven shaft; and the vane rotor has a plurality of vane parts that is rotatable relative to the housing within a predetermined angular range;

the pulley part is made of a resin;

the housing is insert-molded into the pulley part such that the pulley part is formed integrally with the housing;

the rear plate and the housing are made of a metal;

the rear plate is fastened to the housing through a threaded member;

the housing has a cup shape with a bottom; and the pulley part covers an outer circumference of the housing.

2. The valve timing adjuster according to claim 1, wherein:

the housing has a bonding surface that is bonded with the pulley part; and the bonding surface is formed with a recess/protrusion part that is recessed at the bonding surface or projects from the bonding surface.

3. The valve timing adjuster according to claim 2, wherein:

the recess/protrusion part is recessed or projects in a radial direction of the housing.

4. The valve timing adjuster according to claim 1, wherein:

the rear plate is made of a solid material, the valve timing adjuster further comprising:

an O-ring that is oil tightly provided to a position radially outward of the opening of the housing, wherein the O-ring prevents leakage of oil to an exterior through a boundary between the housing and the rear plate.

5. A valve timing adjuster mounted to a driving force transmission system, wherein the driving force transmission system transmits a driving force through a timing belt from a drive shaft to a driven shaft that opens and closes at least one of an intake valve and an exhaust valve, the timing belt being rotatable synchronously with rotation of the drive shaft, the valve timing adjuster comprising:

a pulley part that is rotatable synchronously with the drive shaft through engagement with the timing belt;

a housing formed integrally with the pulley part; and a vane rotor that is received within the housing, wherein:

the vane rotor is rotatable synchronously with the driven shaft;

the vane rotor has a plurality of vane parts that is rotatable relative to the housing within a predetermined angular range;

the pulley part is made of resin;

the housing is insert-molded into the pulley part such that the pulley part is formed integrally with the housing;

the rear plate and the housing are made of metal;

the plate is fastened to the housing through a threaded member;

the housing has a cup shape with a bottom;

the pulley part covers an outer circumference of the housing;

the housing has a bonding surface that is bonded with the pulley part;

the housing includes a plurality of pairs of a protrusion and a recess; and each pair of the protrusion and the recess is arranged on the bonding surface in such a manner that the protrusion projects radially and outward from the bonding surface, and the recess is recessed radially and inward to a center of the housing.

6. The valve timing adjuster according to claim 5, wherein:

each protrusion includes an undercut part, which is recessed at the bonding surface partially at a crest part of the protrusion.

* * * * *